US005988738A

United States Patent [19]

Blessing et al.

[11] Patent Number: 5,988,738

[45] Date of Patent: Nov. 23, 1999

[54] SEAT GROUP ELEMENT

[76] Inventors: Veit Blessing, Panoramastrasse 61, D-73035 Göppingen; Martin Röder, Kitzen 7, D-73113 Ottenbach, both of Germany

[21] Appl. No.: 08/952,122

[22] PCT Filed: May 9, 1996

[86] PCT No.: PCT/EP96/01943

§ 371 Date: Mar. 30, 1998

§ 102(e) Date: Mar. 30, 1998

[87] PCT Pub. No.: WO96/35352

PCT Pub. Date: Nov. 14, 1996

[30] Foreign Application Priority Data

May 11, 1995 [DE] Germany ..... 195 16 947

[51] Int. Cl.[6] ..... A47B 3/14; A47C 4/04; A47C 7/50

[52] U.S. Cl. ..... 297/141; 297/174; 297/16.2; 297/423.11; 297/173

[58] Field of Search ..... 297/423.11, 423.12, 297/140, 141, 170, 173, 174, 16.2

[56] References Cited

U.S. PATENT DOCUMENTS

| | | | |
|---|---|---|---|
| 3,310,340 | 3/1967 | Brewer et al. | 297/16.2 X |
| 4,569,555 | 2/1986 | Lehman | 297/141 |
| 4,614,378 | 9/1986 | Picou | 297/423.11 X |
| 4,650,249 | 3/1987 | Serber | 297/423.11 X |
| 4,798,411 | 1/1989 | Lin | 297/174 X |
| 5,251,961 | 10/1993 | Pass | 297/423.12 |
| 5,401,078 | 3/1995 | Riach | 297/215.13 X |
| 5,542,746 | 8/1996 | Bujaryn | 297/423.12 |

FOREIGN PATENT DOCUMENTS

| | | | |
|---|---|---|---|
| 476215 | 12/1952 | Italy | 297/174 |
| 670180 | 10/1964 | Italy | 297/174 |

*Primary Examiner*—Peter M. Cuomo
*Assistant Examiner*—David E. Allred
*Attorney, Agent, or Firm*—Friedrich Kueffner

[57] ABSTRACT

A seat group element is used primarily in the hotel trade and restaurant trade, e.g., in beer gardens, bistros and the like establishments. The seat group element in question is designed in such a way that a seat and a table are provided simultaneously on a frame which can be set up on a floor or the like surface.

4 Claims, 1 Drawing Sheet

SEAT GROUP ELEMENT

BACKGROUND OF THE INVENTION

1. Field of the Invention

The invention is directed to a seat group element and is used primarily in the hotel trade and restaurant trade, e.g., in beer gardens, bistros and the like establishments. The invention can also be used in offices or in the home.

2. Description of the Related Art

In known furnishings for the hotel trade and restaurant trade, tables and chairs or stools are generally separate units. It is disadvantageous that much time and a correspondingly large interim storage surface area for tables and chairs or stools are required for setting up a beer garden or sidewalk bistro whose floor must be cleared for given periods of time periodically, usually daily.

Further, AT 387 314 B discloses a frame for a table which is preferably used as school furniture, which frame simultaneously has supporting elements for the seat. The frame is so arranged that the table and seat are adjustable relative to one another in different positions. However, this school furniture is not suitable as a seat group element which can be set up in variable ways for bistros or beer gardens, because, at least as a result of the construction principle that is used, it is very heavy, has thick structural members and supports, and some time must be spent folding it up for purposes of transporting and storage.

SUMMARY OF THE INVENTION

Therefore, the object of the invention is to provide a seat group element for bistros, beer gardens and the like establishments which does not have the disadvantages mentioned above and which, in addition, can still be employed in a variable and portable manner and which is based on the principle of a common frame shared by the table and seat.

This object is met by a seat group element including a two-armed frame which can be set up on a floor or the like surface, wherein the frame includes a rod-shaped tables support and a rod-shaped seat support which are connected in an articulated manner.

The invention will be explained more fully hereinafter with reference to an advantageous embodiment example shown schematically in the drawings.

DESCRIPTION OF THE PREFERRED EMBODIMENTS

Figure 1:
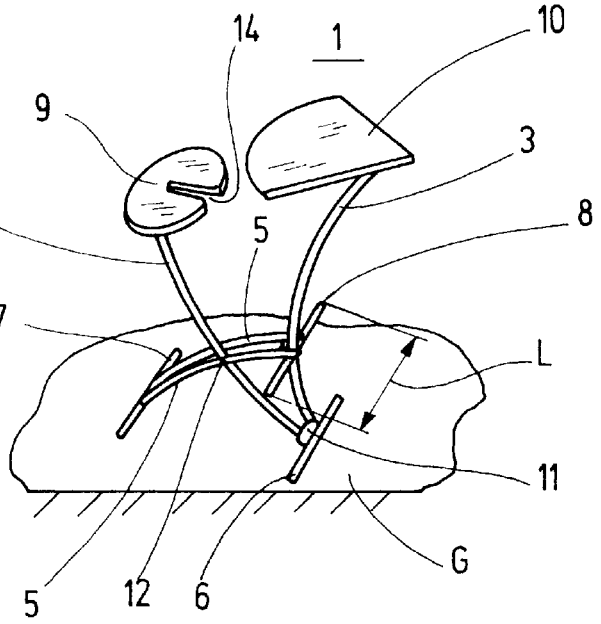
FIG. 1 shows a special, collapsible variant of the novel seat group element.

In FIG. 1, the novel seat group element 1 in the advantageous collapsible construction variant is shown folded out for use on a floor surface G, wherein, in the present case, a seat 9 and a table 10 are provided simultaneously on the same frame 2.

In this special constructional configuration, the frame 2 has a two-arm configuration such that there is provided a rod-shaped table support 3 ascending from a first base crosspiece 6 and a rod-shaped seat support 4, and such that a supporting member 5 extending toward the back and provided at its end with a second base crosspiece 7 engages at the table support 3, wherein the supporting member 5 is preferably constructed in this case as a double-supporting member. In this case, the table 10 preferably has the shape of a circle sector. However, other shapes are also possible. A table with a large surface or a bench is formed by arranging in a desired manner a plurality of these seat group elements adjacent to one another.

In the embodiment example shown in FIG. 1, the supporting member 5 is connected in an articulated manner with the seat support 4 by a pin 12 and is guided by means of a collar 13 so as to be movable at the table support 3, and the seat support 4 is held at the floor side at the first base crosspiece 6 by means of an articulated collar 11. Further, a foot rest 8 is arranged so as to extend transversely at both sides at the rod-shaped table support 3, wherein the length L of the foot rest 8 is preferably less than the width B of the table 10 and the foot rest 8 is simultaneously designed as a stop for the collar 13 of the supporting member 5.

In a further construction variant, not shown in the drawing, the frame 2 has, proceeding from the first base crosspiece 6, only an ascending table support 3 and a supporting member 5 which proceeds from the table support 3, extends toward the back and is provided at the end with a second base crosspiece 7, and the seat support 4 is provided at the supporting member 5 so as; to project upward.

It is essential to the invention that the materials and sections of material used for constructing the seat group element 1, for the frame 2 as well as for the seat 9 and the table 10, conform to the location where the seat group element is to be set up and to the requirements of the purchaser.

Figure 2:
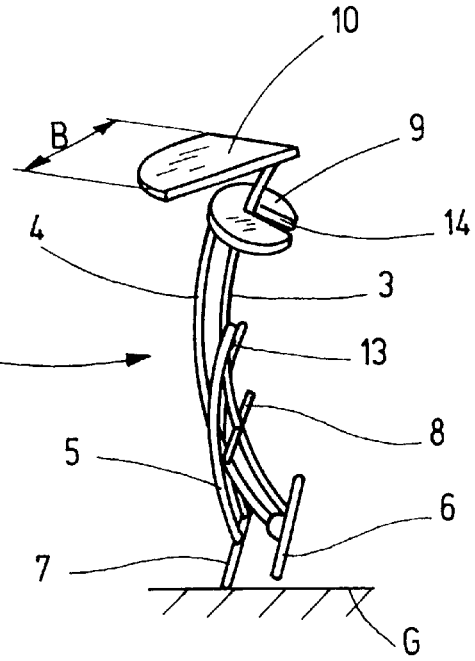
FIG. 2 shows the seat group element in the collapsed state and stored upright.
Figure 3:
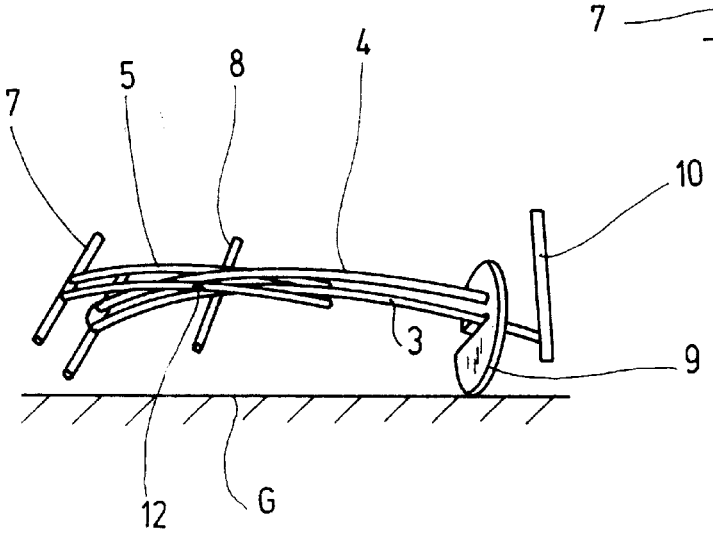
FIG. 3 shows the seat group element in the collapsed state and stored horizontally.

The seat group element 1 which is shown in FIG. 1 is shown in the collapsed state stored in the standing position and in the horizontal position, respectively, in FIGS. 2 and 3. This collapsible construction variant of the invention is of primary importance in view of the space that can be saved when storing.

As is shown in FIG. 2, a slot 14 that is worked into the seat 9 benefits compact dimensions in the collapsed state.

We claim:

1. A seat group element comprised of a frame configured to be set up on a floor or the like surface, the frame being comprised of a two-arm configuration with a first rod-shaped table support arm and a second rod-shaped seat support arm, further comprising a first base crosspiece, wherein the table support arm is connected to the first base crosspiece and extends upwardly from the first base crosspiece, and wherein the seat support arm is connected to the first base crosspiece and extends upwardly from the first base crosspiece, further comprising a second base crosspiece, and a supporting member having first and second ends, the first end of the supporting member being connected to the second base crosspiece and the second end of the supporting member being connected to the table support arm, wherein the supporting member is pivotally connected at a location intermediate its ends to the seat support arm by a pin and wherein the second end of the supporting member is movably guided at the table support arm by a collar connected to the table support arm, said collar comprising a tubular portion surrounding said table support arm for sliding emgagement along a length thereof, further comprising a foot rest connected to the table support arm so as to extend transversely of the table support arm at both sides thereof, and wherein the foot rest is connected to the table support arm such that the foot rest forms a stop for the collar.

2. The seat group element according to claim 1, wherein a table is mounted on the table support arm, and wherein the foot rest has a length which is smaller than a width of the table.

3. The seat group element according to claim 2, wherein the table has a circular sector shape.

4. The seat group element according to claim 1, further comprising an articulated collar connected to the first base crosspiece, wherein the seat support arm is connected to the articulated collar.

* * * * *